US011649744B2

(12) United States Patent
DeGroot et al.

(10) Patent No.: US 11,649,744 B2
(45) Date of Patent: May 16, 2023

(54) CAPSTAN-DRIVEN AIR PUMP SYSTEM FOR OPENING AND CLOSING A LONGITUDINAL RAILCAR DOOR

(71) Applicant: TrinityRail Products and Services, LLC, Dallas, TX (US)

(72) Inventors: Robert J. DeGroot, Keller, TX (US); Kenneth W. Huck, Fairview, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 387 days.

(21) Appl. No.: 17/080,980

(22) Filed: Oct. 27, 2020

(65) Prior Publication Data

US 2021/0123362 A1 Apr. 29, 2021

Related U.S. Application Data

(60) Provisional application No. 62/926,939, filed on Oct. 28, 2019.

(51) Int. Cl.

| | |
|---|---|
| ***B61D 7/18*** | (2006.01) |
| ***F01L 25/06*** | (2006.01) |
| ***F04B 9/125*** | (2006.01) |
| ***B61D 7/28*** | (2006.01) |

(52) U.S. Cl.

CPC ..... *F01L 25/063* (2013.01); *B61D 7/18* (2013.01); *B61D 7/28* (2013.01); *F04B 9/125* (2013.01)

(58) Field of Classification Search

CPC ... B61D 7/16; B61D 7/18; B61D 7/20; B61D 7/28; F01L 25/063; F04B 9/125

See application file for complete search history.

(56) References Cited

U.S. PATENT DOCUMENTS

| | | | | |
|---|---|---|---|---|
| 3,561,368 | A * | 2/1971 | Giesking | B61D 7/20 105/287 |
| 4,601,244 | A * | 7/1986 | Fischer | B61D 7/28 105/299 |
| 6,067,912 | A * | 5/2000 | Miller | B61D 7/28 105/283 |
| 8,915,194 | B2 * | 12/2014 | Creighton | B61D 7/24 105/286 |
| 2014/0261069 | A1 * | 9/2014 | Bis | B61D 7/26 105/253 |
| 2018/0201279 | A1 * | 7/2018 | Huck | B61D 7/18 |

* cited by examiner

*Primary Examiner* — Robert J McCarry, Jr.
(74) *Attorney, Agent, or Firm* — Baker Botts L.L.P.

(57) ABSTRACT

According to some embodiments, an apparatus comprises an air pump configured to couple to a capstan, and a pneumatic cylinder coupled to the air pump at a first end of the pneumatic cylinder. The pneumatic cylinder comprises a piston. Rotation of the capstan in a first rotational direction causes the air pump to provide air pressure to the first end of the pneumatic cylinder. In response to the air pump providing air pressure to the first end of the pneumatic cylinder, the piston of the pneumatic cylinder moves in a first linear direction. The piston is coupled to a longitudinal beam of a longitudinal door system of a railcar. In response to the piston moving in the first linear direction, the longitudinal beam moves in the first linear direction, opening a door of the longitudinal door system.

21 Claims, 10 Drawing Sheets

CAPSTAN-DRIVEN AIR PUMP SYSTEM FOR OPENING AND CLOSING A LONGITUDINAL RAILCAR DOOR

PRIORITY

This application claims priority, under 35 U.S.C. § 119(e), to U.S. Provisional Patent Application No. 62/926,939 filed Oct. 28, 2019, titled "CAPSTAN-DRIVEN AIR PUMP SYSTEM FOR OPENING AND CLOSING A LONGITUDINAL RAILCAR DOOR," which is hereby incorporated by reference in its entirety.

TECHNICAL FIELD OF THE INVENTION

Particular embodiments relate generally to railcars, and more particularly to a capstan-driven air pump system for opening and closing a longitudinal door of a railcar.

BACKGROUND

Hopper-type railcars are typically used to transport lading. The lading is loaded through the top of the car for transport to a destination where it is discharged through an opening at the bottom of the car. Many hopper-type railcars use sliding gate assemblies mounted on the discharge openings, to control the discharge of the lading. Each sliding gate assembly typically includes a door plate and a drive for moving the plate between open and closed positions. When the plate is in the closed position, the plate covers the railcar opening and prevents the lading from discharging through the opening. On the other hand, when the plate is in the open position, lading may freely discharge through the opening.

Such sliding gate assemblies are typically controlled mechanically, with the use of a capstan. Here, the capstan is used to provide rotation and torque, which is converted to a sliding motion of the gate through the use of a rack and pinion drive. Accordingly, many unloading facilities are set up for capstan operations, including some that use sophisticated robotic and visual systems.

Longitudinal door systems have also been developed for hopper-type railcars. Each longitudinal door system typically includes one or more doors attached to a sliding longitudinal beam via struts. When the longitudinal beam travels in one direction, the doors may be rotated opened by the struts. When the longitudinal beam travels in the other direction, the doors may be rotated closed by the struts.

Such door systems often use a pneumatic cylinder to move the longitudinal beam. However, many conventional unloading facilities, already equipped with capstans, may be reluctant to provide trackside air to operate such pneumatic cylinders. Accordingly, some implementations of longitudinal door systems have sought to employ mechanical devices, rather than pneumatic cylinders, to move the longitudinal beams of the door systems.

SUMMARY

This disclosure contemplates a capstan-driven air pump system for opening and closing a longitudinal door of a railcar that addresses one or more of the above technical difficulties. The system uses existing capstan infrastructure, generally available at conventional railcar unloading facilities, coupled to an air pump or compressor, to provide air pressure and volume to a pneumatic cylinder. This air pressure and volume is used to move the piston of the cylinder, generating linear motion that may be used to move the longitudinal beam of a longitudinal door system, thereby opening or closing the doors of the longitudinal door system.

In certain embodiments, a longitudinal door system of a railcar may be operated either by using trackside air coupled to the pneumatic cylinder, or by using a mechanical capstan drive coupled to an air pump or compressor, which may then provide air pressure and volume to the pneumatic cylinder. Accordingly, railcars equipped with longitudinal door systems may easily be incorporated into existing railcar fleets, without a need for existing unloading facilities to provide trackside air, to accommodate such railcars. Instead, the capstan-driven air pump system of the present disclosure may allow for an industry transition period from capstan-driven railcar doors to air actuated doors.

Certain embodiments of the capstan-driven air pump system may provide one or more technical advantages. For example, an embodiment may enable the use of existing capstan drives to operate longitudinal railcar doors. As another example, an embodiment may allow for an industry transition period, where companies may incorporate railcars that include longitudinal door systems into their railcar fleets, without a worry that conventional unloading facilities will not be able to accommodate such railcars. As a further example, an embodiment may capture excess air pressure and volume in a reservoir, which may later be used to open and/or close the longitudinal doors of a railcar when access to either a capstan or trackside air is unavailable. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 14 of the drawings, like numerals being used for like and corresponding parts of the various drawings.

Figure 1B:
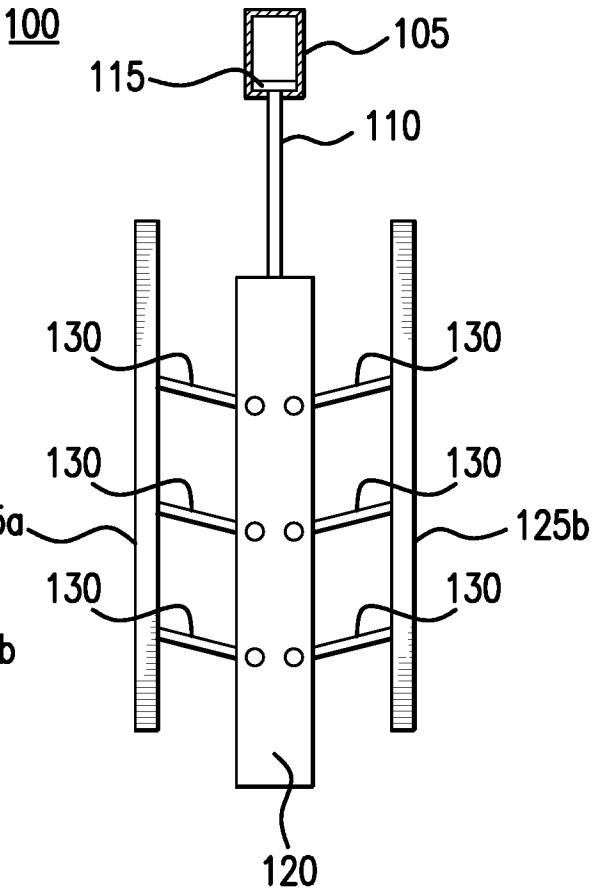
FIGS. 1A and 1B illustrate an example longitudinal door system.
Figure 1A:
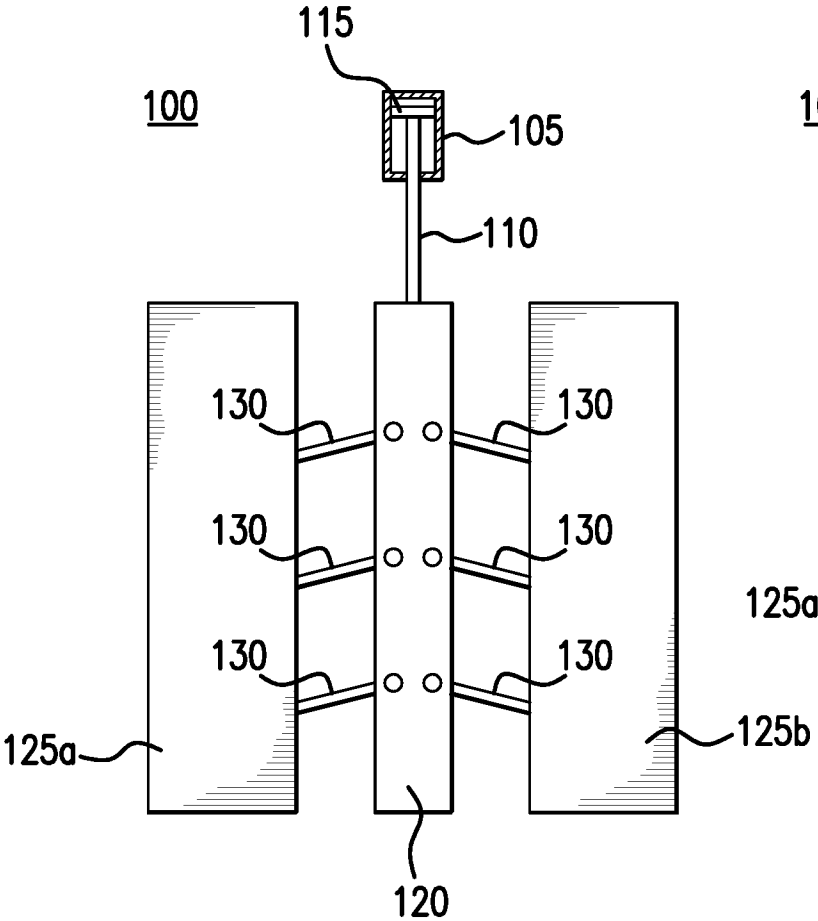

FIGS. 1A and 1B illustrate an example longitudinal door system 100 that may be used with the capstan-driven air pump system of the present disclosure. Such a longitudinal door system may be included in railcars such as hopper and gondola cars. As illustrated in FIGS. 1A and 1B, longitudinal door system 100 may include one or more doors 125 attached to a sliding longitudinal beam 120 via struts 130. For example, longitudinal door system 100 may include a pair of doors 125*a* and 125*b*. In particular embodiments, longitudinal door system 100 may include any number of struts 130. When longitudinal beam 120 travels in a first direction, doors 125*a* and 125*b* may be rotated open by struts 130, as illustrated in FIG. 1B. When longitudinal beam 120 travels in a second direction, opposite the first direction, doors 125*a* and 125*b* may be rotated closed by struts 130, as illustrated in FIG. 1A.

As illustrated in FIGS. 1A and 1B, the longitudinal door system may be coupled to a pneumatic cylinder 105. Air pressure and volume may be applied to pneumatic cylinder 105 to move piston 115 in pneumatic cylinder 105. Piston rod 110 may be coupled to longitudinal beam 120, such that movement of piston 115 in pneumatic cylinder 105 causes piston rod 110 to move longitudinal beam 120. In particular embodiments, pneumatic cylinder 105 may be operated in any suitable manner. For example, air volume may be applied to pneumatic cylinder 105 to generate pressure to move piston 115. Alternatively, air volume may be removed from pneumatic cylinder 105 to generate a vacuum to move piston 115. Such operations of pneumatic cylinder 105 is described in further detail below.

Figure 2:
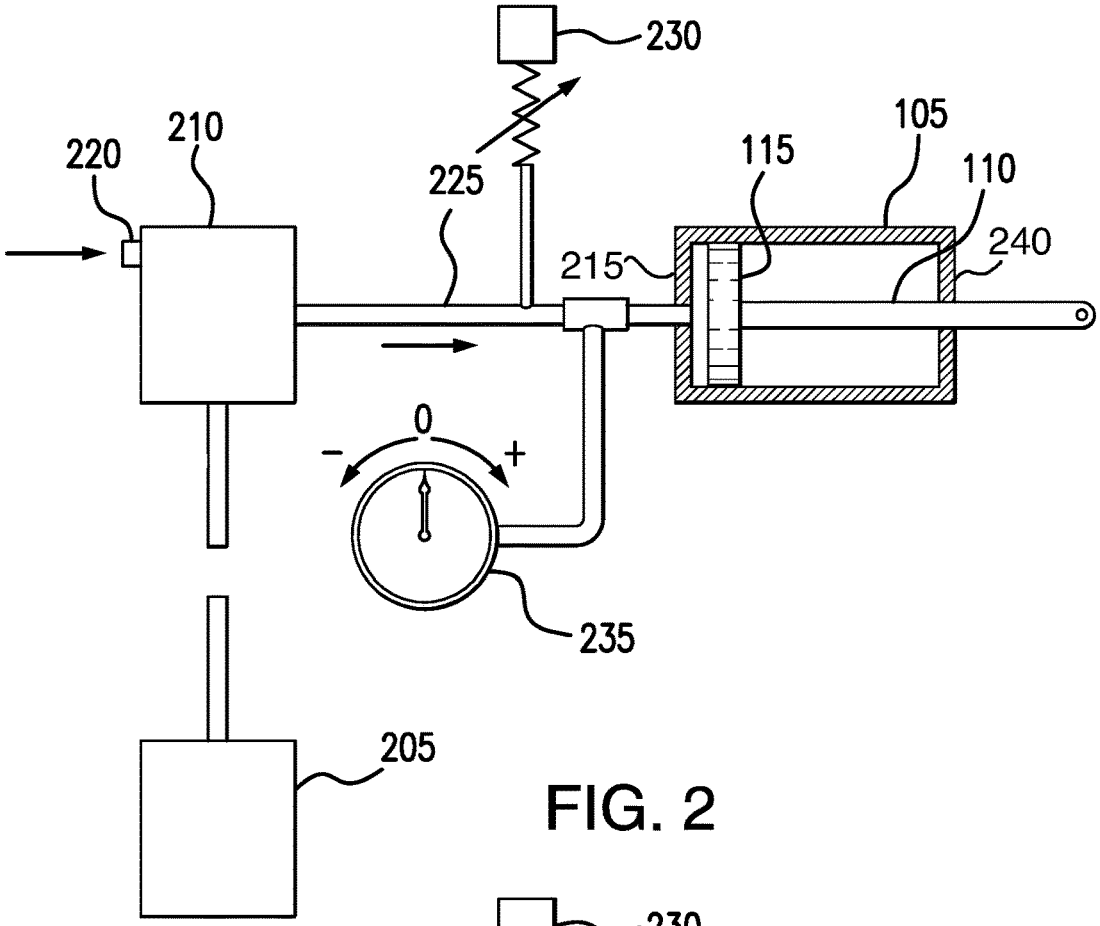
FIG. 2 illustrates an example embodiment of the capstan-driven air pump system.

FIG. 2 illustrates an example embodiment of the capstan-driven air pump system of the present disclosure. As illustrated in FIG. 2, the capstan-driven air pump system includes a capstan drive 205, air pump or compressor 210, and pneumatic cylinder 105. Air pump or compressor 210 includes air inlet/outlet 220. Pneumatic cylinder 105 includes piston 115 and piston rod 110. In certain embodiments, the capstan-driven air pump system may also include pressure relief valve 230 and/or pressure gauge 235.

Air pump/compressor 210 and pneumatic cylinder 105 may be mounted on the underside of a railcar to operate a longitudinal door system 100 of the railcar. On the other hand, capstan drive 205 may be located externally to the railcar. For example, capstan drive 205 may be located trackside at a conventional railcar unloading facility.

Pneumatic cylinder 105 and air pump/compressor 210 may be separate from one another. For example, pneumatic cylinder 105 and air pump/compressor 210 may be separate pieces of equipment, mounted at different locations on the underside of a railcar, and coupled to one another through hose/pipe 225. The use of air pump/compressor 210 separate from pneumatic cylinder 105 may provide flexibility in where air pump/compressor 210 may be mounted. For example, air pump/compressor 210 may be mounted in any convenient location for access for use or service.

As illustrated in FIG. 2, initially, when capstan drive 205 is not connected to air pump/compressor 210, there is no air pressure in the system. This is indicated by pressure gauge 235 reading zero. FIG. 2 additionally illustrates piston 115 of pneumatic cylinder 105 in a door-closed position (i.e., piston 115 is positioned within pneumatic cylinder 105 near a first end 215 of pneumatic cylinder 105 that is coupled to air pump 210 (through hose/pipe 225), and far from a second end 240 of pneumatic cylinder 105, through which piston rod 110 moves). As illustrated in FIG. 1A, such positioning of piston 115 corresponds to doors 125*a* and 125*b* being in a closed position.

Figure 3:
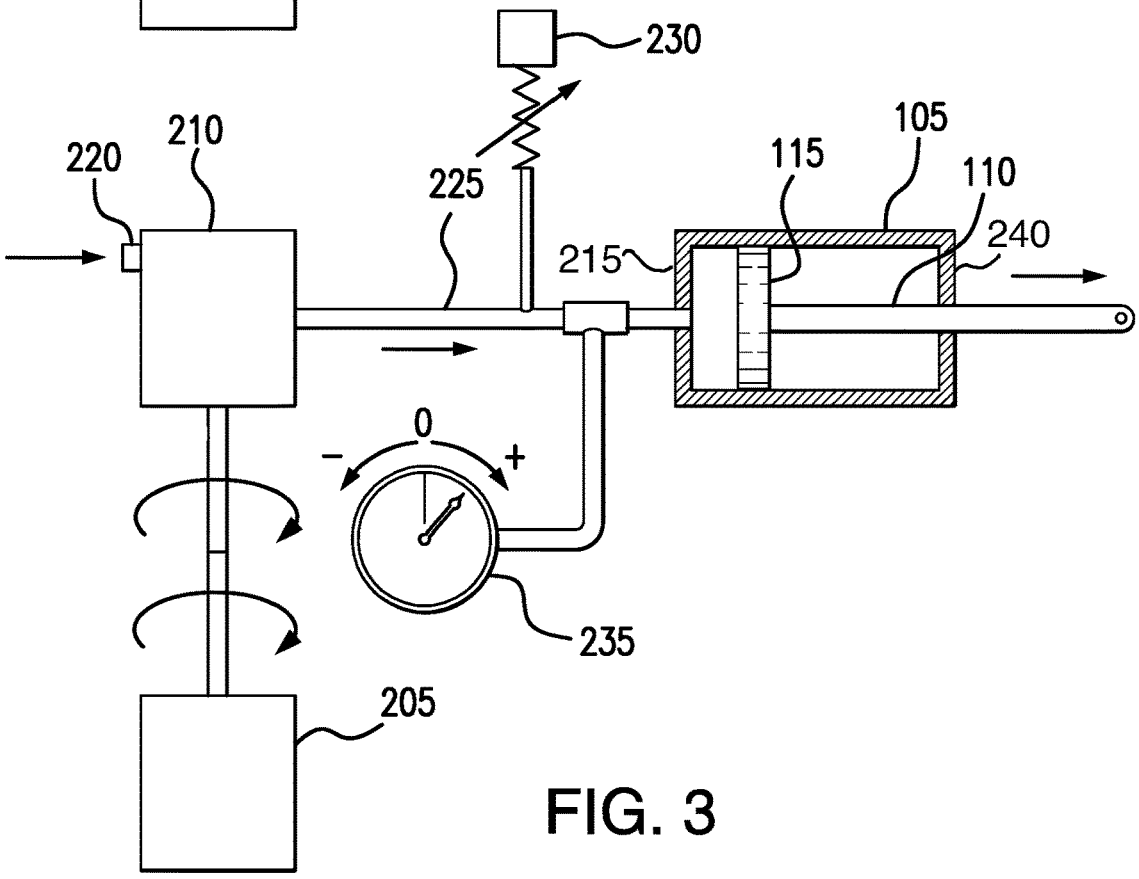
FIG. 3 illustrates an example operation of the capstan-driven air pump system of FIG. 2, in which an air pump, powered by the capstan drive, is moving a piston of a pneumatic cylinder in a first direction.

FIG. 3 illustrates an example of the operation of the capstan-driven air pump system illustrated in FIG. 2. As illustrated in FIG. 3, during operation of the capstan-driven air pump system, capstan drive 205 is mechanically engaged to air pump/compressor 210. Capstan drive 205 may be actuated such that rotation and torque from the capstan rotates the air pump or compressor 210, to generate air pressure and volume. As illustrated with pressure gauge 235, positive air pressure is now being supplied to pneumatic cylinder 105. This air may be delivered to first end 215 of pneumatic cylinder 105, to move piston 115 in a first direction (e.g., the direction away from first end 215 of pneumatic cylinder 105). The linear motion of piston 115 (and correspondingly piston rod 110) may be used to open the longitudinal doors of the railcar, as illustrated in FIG. 1B.

Figure 4:
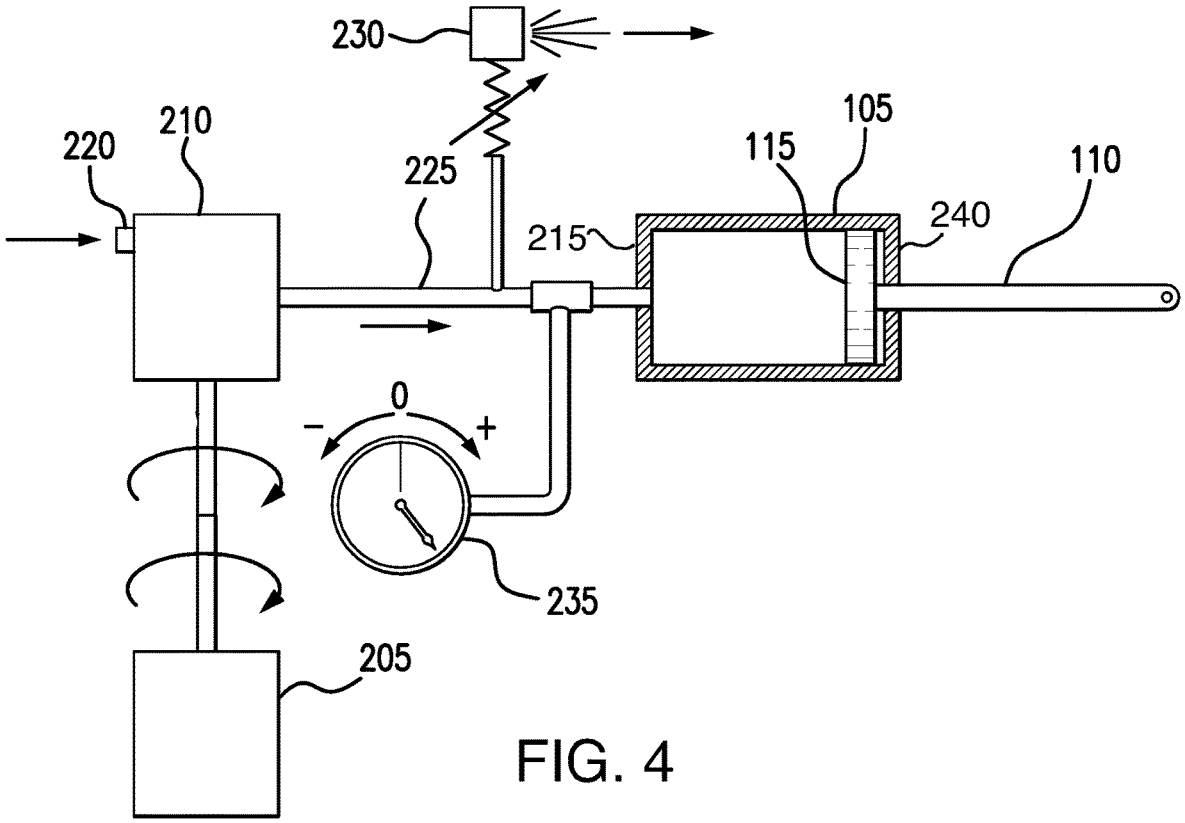
FIG. 4 illustrates an example operation of the capstan-driven air pump system of FIG. 2, in which a pressure relief valve is used to remove excess pressure generated by the air pump.

FIG. 4 illustrates an example operation of the capstan-driven air pump system of FIG. 2, in which piston 115 has reached second end 240 (i.e., the end opposite to first end 215) of pneumatic cylinder 105. As illustrated in FIG. 4, in certain embodiments, capstan drive 205 may continue to operate even after piston 115 has reached second end 240 of pneumatic cylinder 105 (i.e., corresponding to the door motion of the longitudinal door system having stopped). In such embodiments, air pump/compressor 210 may generate excessive air pressure in the system. In certain such embodiments, the design of air pump/compressor 210 may be such that it can withstand any excessive pressure that may be generated. In certain other embodiments, and as illustrated in FIG. 4, the system may be designed such that excessive pressure may be exhausted to the atmosphere, such as through pressure relief valve 230.

Figure 5:
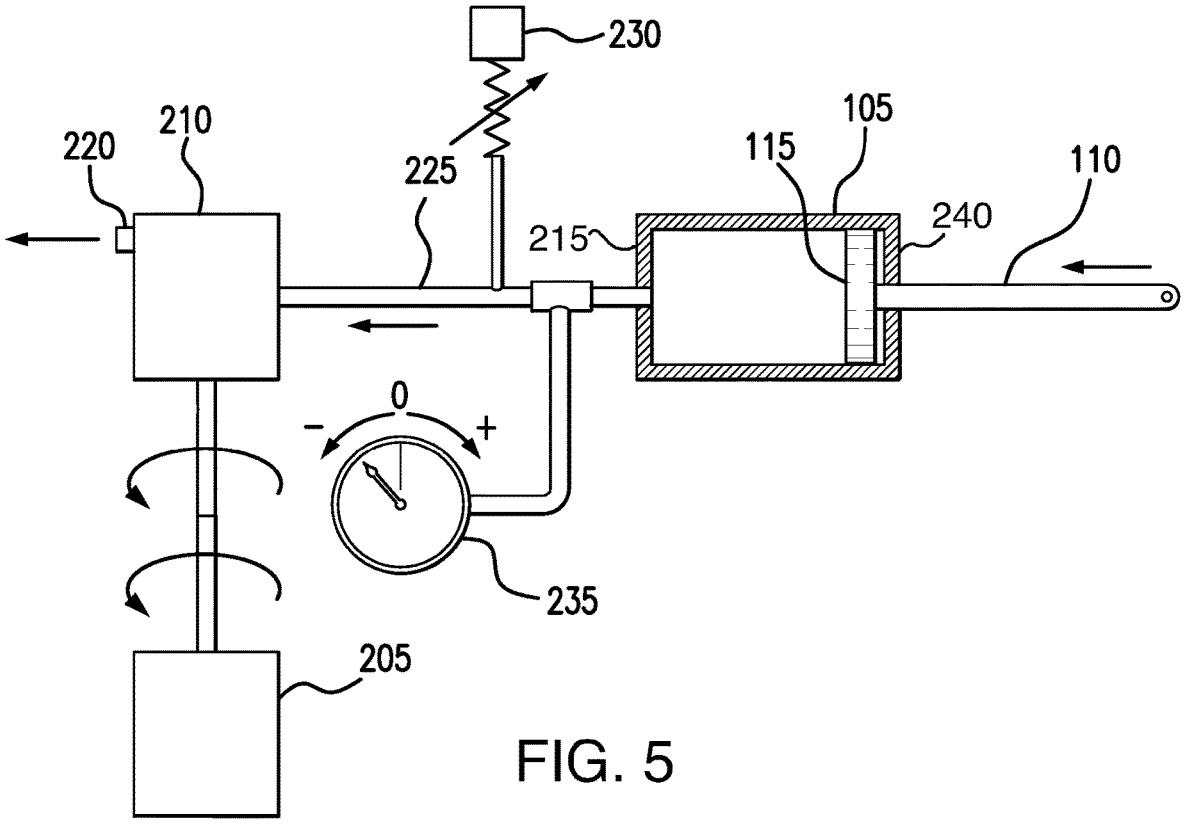
FIG. 5 illustrates an example operation of the capstan-driven air pump system of FIG. 2, in which the direction of the capstan is reversed, causing the air pump to move the piston of the pneumatic cylinder in a second direction, opposite the first direction.

FIG. 5 illustrates an example of the operation of the capstan-driven air pump system illustrated in FIG. 2, in which the direction of operation of capstan drive 205 has been reversed, as compared to the operation illustrated in FIGS. 3 and 4. As illustrated by pressure gauge 235, reversing the direction of operation of capstan drive 205 leads to air pump/compressor 210 removing air from the system, generating a vacuum. Supplying this vacuum to pneumatic cylinder 105 causes piston 115 to move in a second direction, opposite the first direction, toward first end 215 of pneumatic cylinder 105. This movement of piston 115 may continue until piston rod 110 is in its fully retracted position within pneumatic cylinder 105.

Figure 6A:
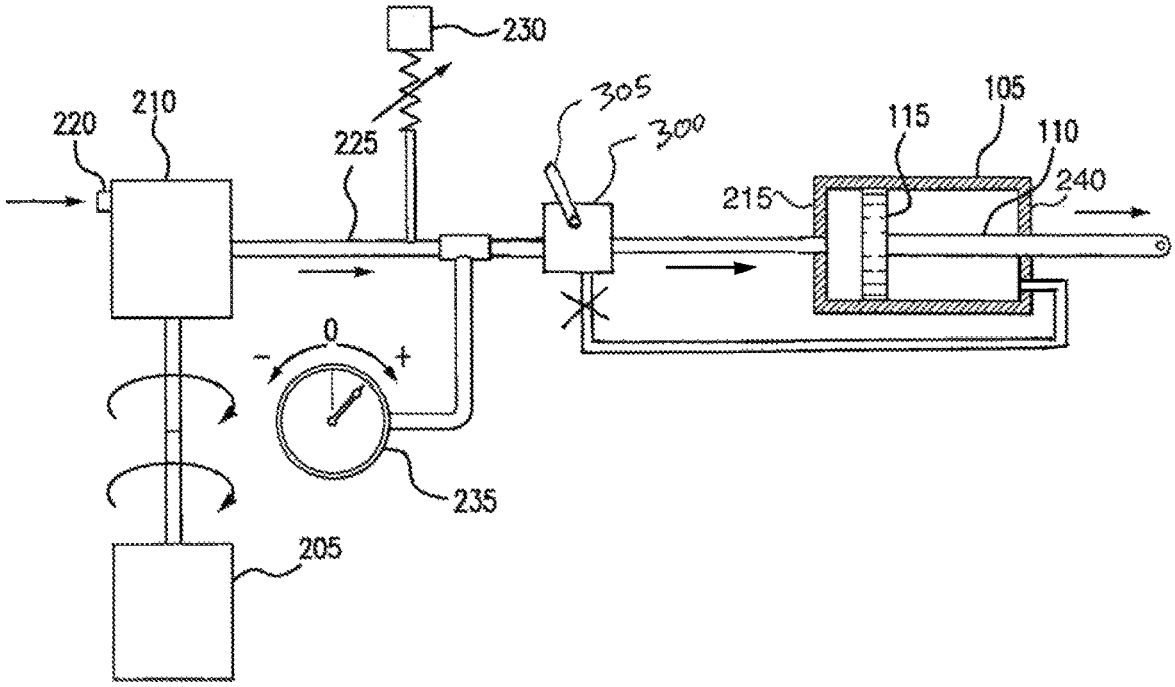
FIGS. 6A and 6B illustrate an example embodiment of the capstan-driven air pump system in which a valve may be used to control the direction of movement of a piston of a pneumatic cylinder.
Figure 6B:
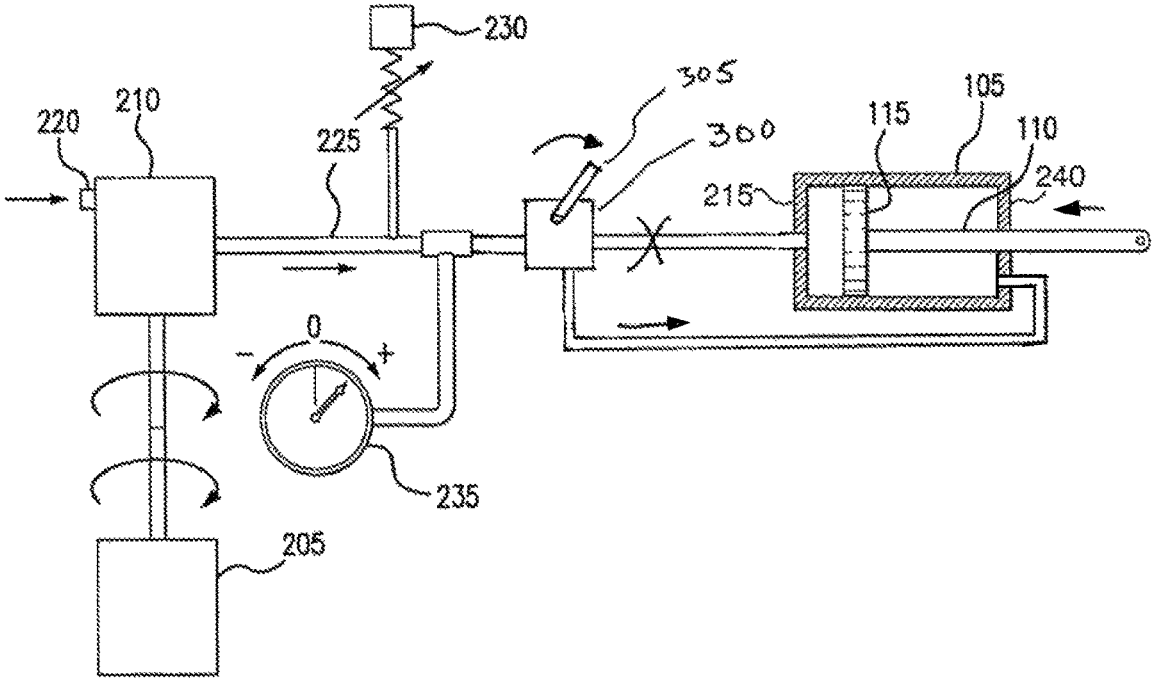

In certain embodiments, and as illustrated in FIGS. 6A and 6B, a valve 300 may be used to control the direction of movement of piston 115 in pneumatic cylinder 105. Valve 300 may be operated using lever 305. FIG. 6A presents an example in which lever 305 on valve 300 is in a first position. This position allows air from air pump or compressor 210 to be directed to first end 215 of pneumatic cylinder 105 to move piston 115 in a first direction (e.g., the direction away from first end 215 of pneumatic cylinder 105), to open the railcar doors. On the other hand, FIG. 6B presents an example in which lever 305 is in a second position on valve 300. This second position directs air from air pump or compressor 210 to the opposite end 240 of piston 115, to move piston 115 in a second direction (e.g., the direction toward first end 215 of pneumatic cylinder 105), to close the railcar doors. Valve 300 may be manually operated or controlled in any other suitable manner, with or without lever 305. In certain embodiments, this allows the door on the railcar to be opened or closed without having to reverse the direction of the capstan drive.

Figure 7A:
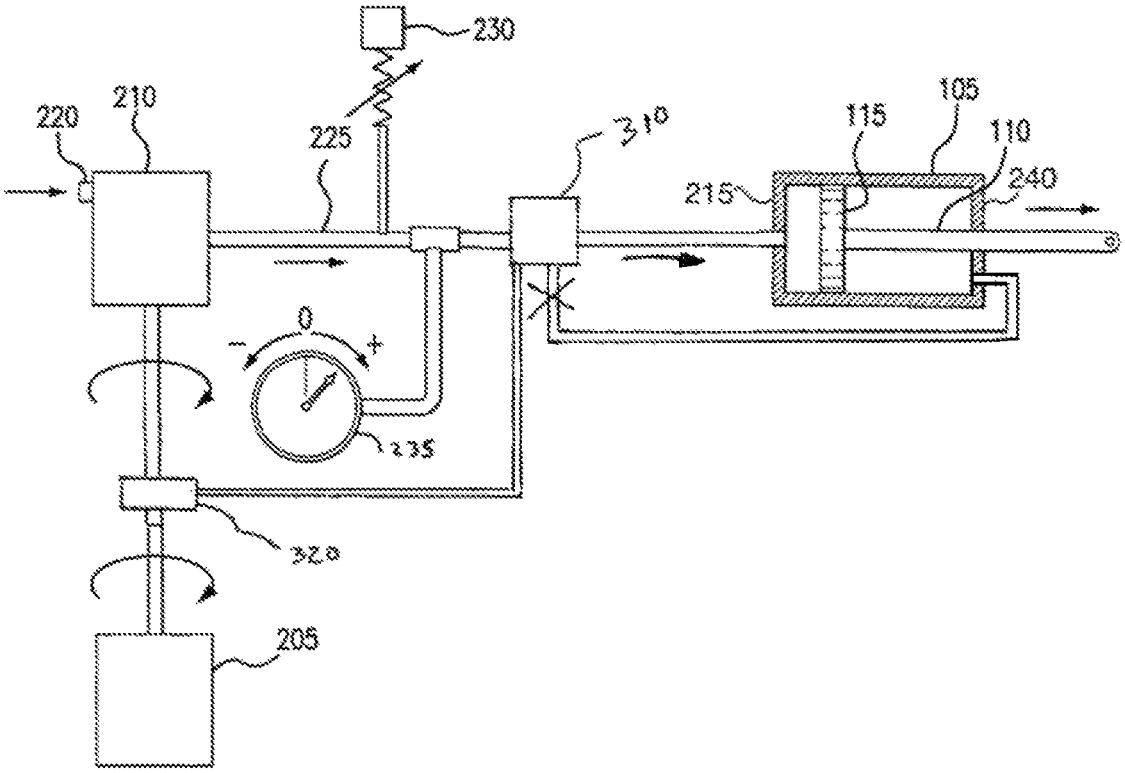
FIGS. 7A and 7B illustrate an example embodiment of the capstan-driven air pump system of FIG. 6, in which a device may be used to control the valve, based on the direction of rotation of the capstan.
Figure 7B:
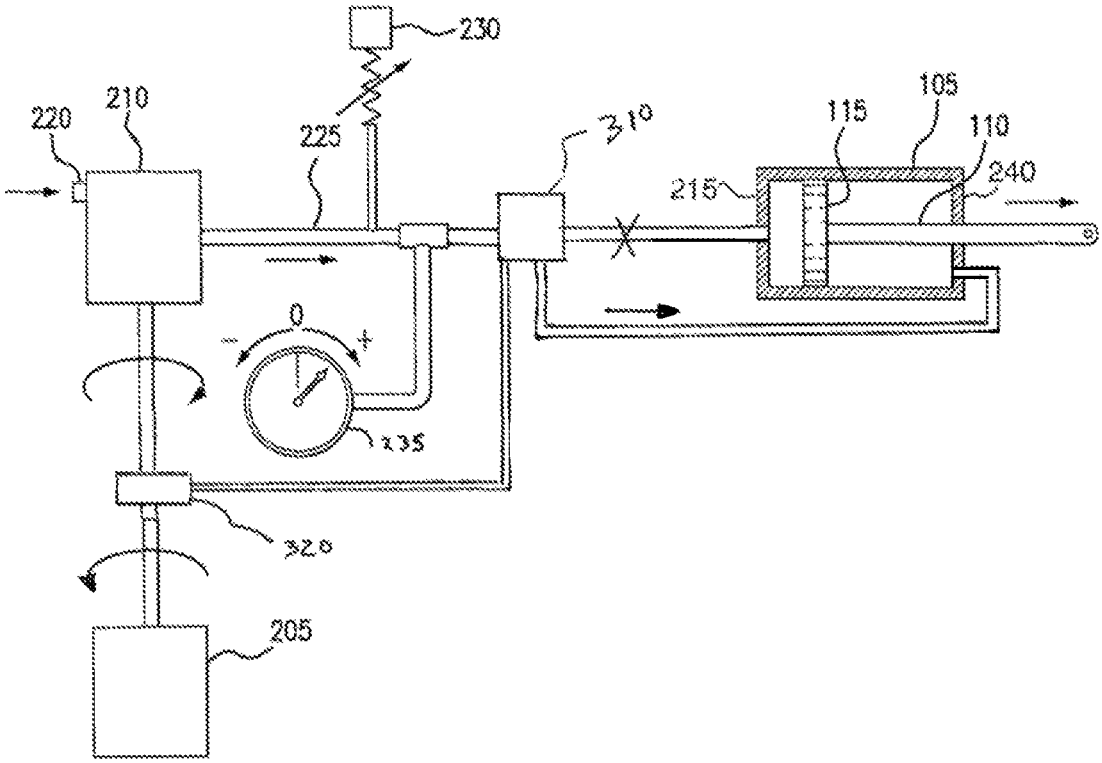

FIGS. 7A and 7B present an example illustrating the use of a device 320 to operate valve 310, in certain embodiments. As illustrated in FIGS. 7A and 7B, device 320 is located between capstan drive 205 and air pump/compressor 210. When capstan drive 205 operates in a first rotational direction, as illustrated in FIG. 7A, air pump or compressor 210 also operates in this first rotational direction. Device 320 transfers the torque and direction of rotation from capstan drive 205 to air pump or compressor 210 and signals valve 310 to direct air to first side 215 of cylinder 105 to move piston 115 in a first direction (e.g., the direction away from first end 215 of pneumatic cylinder 105), to open the railcar doors.

On the other hand, FIG. 7B presents an example in which the direction of capstan drive 205 is reversed. As illustrated in FIG. 7B, in certain embodiments, device 320 may reverse the direction of rotation delivered to air pump or compressor 210 and transmit the torque to air pump/compressor 210 from capstan drive 205 so that air pump/compressor 210 continues to create air volume and pressure. Device 320 may also direct valve 310 to direct air to the opposite end 240 of cylinder 105 to move piston 115 in a second direction (e.g., the direction toward first end 215 of pneumatic cylinder 105), to close the railcar doors. This allows capstan drive 205 to be operated in a first direction to open the railcar doors and in a second direction to close the railcar doors, where air pressure is used in both situations to open and close the railcar doors.

Figure 8:
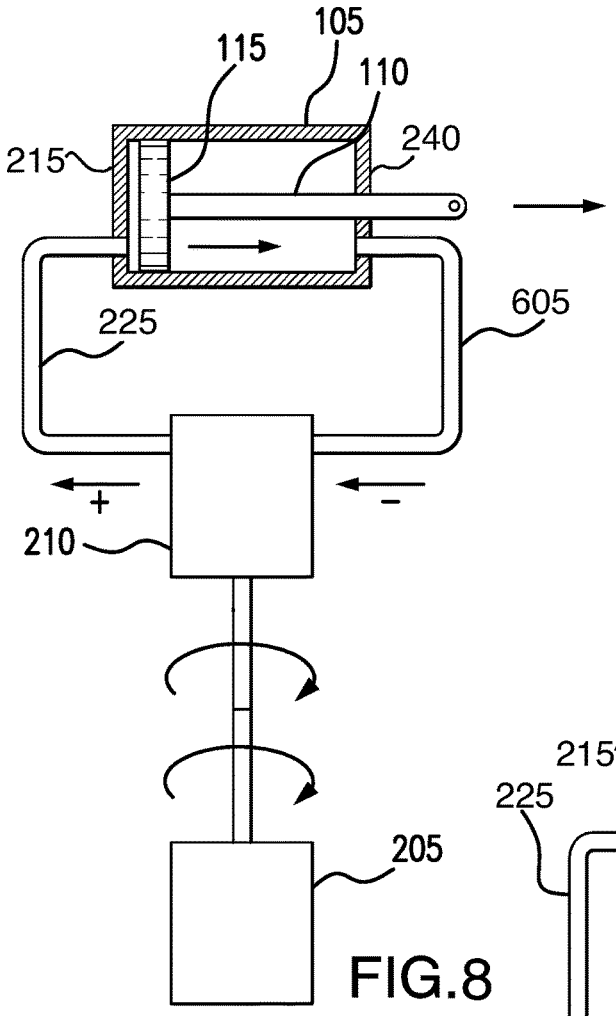
FIG. 8 illustrates another example embodiment of the capstan-driven air pump system, in which the capstan drive is operated in a first direction, to cause the piston of the pneumatic cylinder to move in the first direction.

FIG. 8 illustrates another example embodiment of the capstan-driven air pump system of the present disclosure. As illustrated in FIG. 8, in certain embodiments, air pump/compressor 210 may be coupled to pneumatic cylinder 105 at both first end 215 and second end 240 of pneumatic cylinder 105. For example, a first hose/pipe 225 may connect air pump/compressor 210 to first end 215 of pneumatic cylinder 105 and a second hose/pipe 605 may connect air pump/compressor 210 to second end 240 of pneumatic cylinder 105.

As illustrated in FIG. 8, when capstan drive 205 is operated in a first direction, air pump/compressor 210 may pump air from second hose/pipe 605 into first hose/pipe 225. Accordingly, air pressure and volume are applied to the first side of piston 115 (e.g., the side of piston 115 closest to first side 215 of pneumatic cylinder 105), while a vacuum is applied to the second side of piston 115 (e.g., the side of piston 115 closest to second side 240 of pneumatic cylinder 105). This causes piston rod 110 to move in a first direction, away from first end 215, thereby opening doors 125 of longitudinal door system 100, as illustrated in FIG. 1B.

Figure 9:
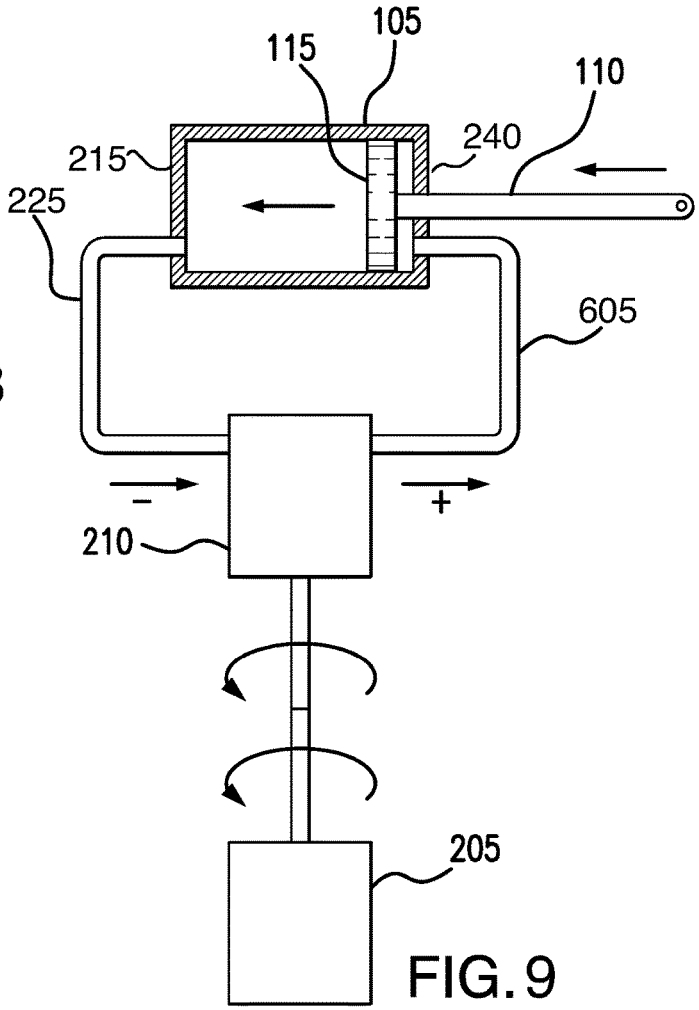
FIG. 9 illustrates the example embodiment of the capstan-driven air pump system of FIG. 8, in which the capstan drive is operated in the reverse direction, to cause the piston of the pneumatic cylinder to move in the second direction.

FIG. 9 illustrates the example embodiment of the capstan-driven air pump system of FIG. 8, in which capstan drive 205 is operated in the opposite direction. As illustrated in FIG. 9, when capstan drive 205 is operated in the opposite direction from that illustrated in FIG. 8, air pump/compressor 210 may pump air from first hose/pipe 225 into second hose/pipe 605. Accordingly, air pressure and volume are applied to the second side of piston 115 (e.g., the side of piston 115 closest to second side 240 of pneumatic cylinder 105), while a vacuum is applied to the first side of piston 115 (e.g., the side of piston 115 closest to first side 215 of pneumatic cylinder 105). This causes piston rod 110 to move in a second direction, opposite the first direction, and away from second end 240, thereby closing doors 125 of longitudinal door system 100, as illustrated in FIG. 1A.

Figure 10:
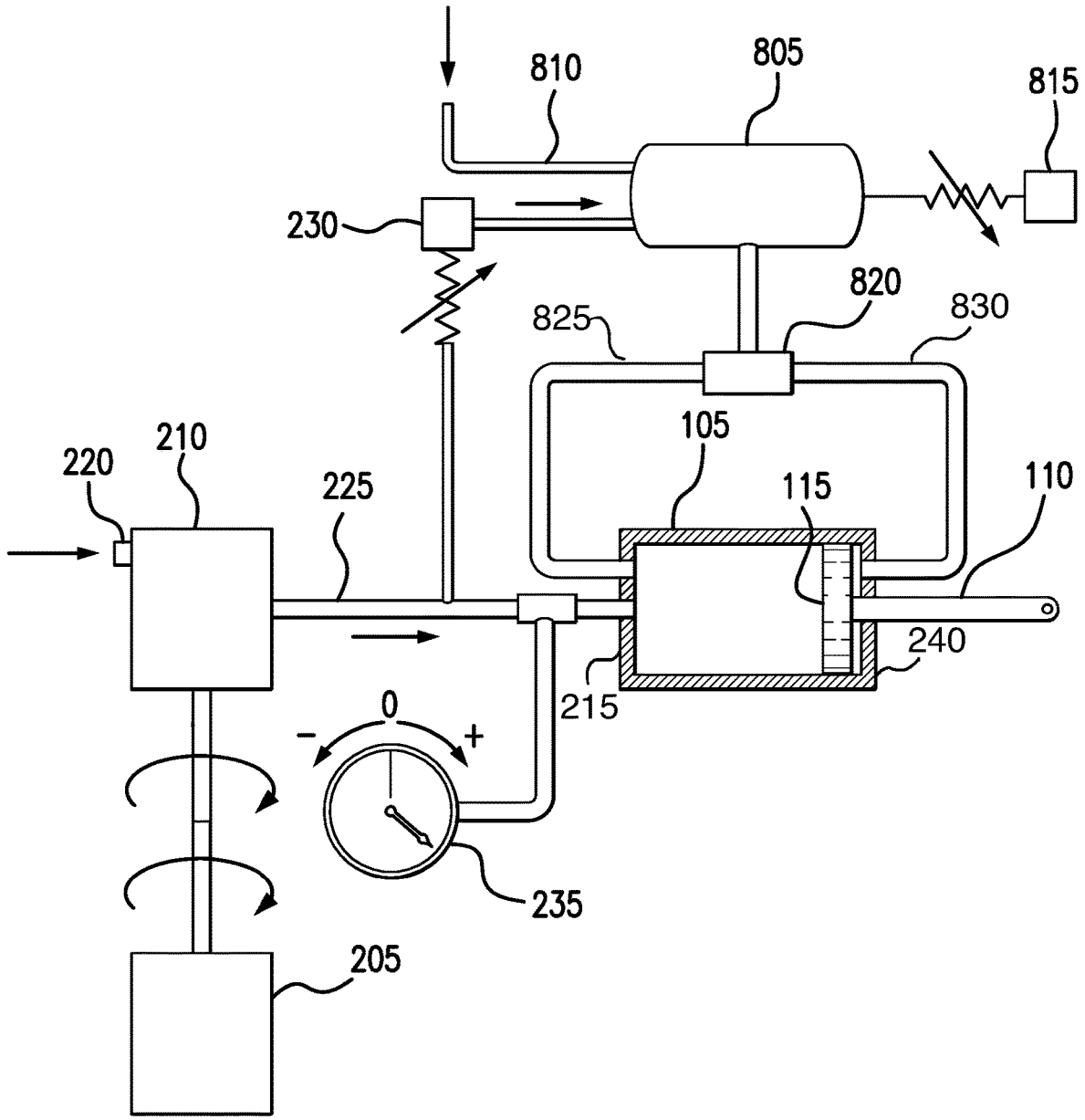
FIG. 10 illustrates an example embodiment of the capstan-driven air pump system in which excess air pressure and volume may be redirected to an air reservoir.

FIG. 10 illustrates an example embodiment of the capstan-driven air pump system of the present disclosure, in which excess air pressure and volume may be redirected to a secondary system. For example, excessive pressure and air volume released through pressure relief valve 230 may be directed into reservoir 805. In certain embodiments, reservoir 805 may be coupled to a pressure relief valve 815, to help ensure that excessive pressure does not accumulate within reservoir 805.

In certain embodiments, the air stored in reservoir 805 may be used to open/close the doors of longitudinal door system 100. For example, as illustrated in FIG. 10, in certain embodiments, valve 820 may be used to direct the air stored in reservoir 805 to pneumatic cylinder 105.

Valve 820 may be any suitable type of valve to control the flow of air. For example, valve 820 may be a manual valve. As another example, valve 820 may be a 2-way valve, as illustrated in FIG. 10, such that valve 820 may be used to direct the air stored in reservoir 805 along first hose/pipe 825 to first end 215 of pneumatic cylinder 105, or along second hose/pipe 830 to second end 240 of pneumatic cylinder 105.

When valve 820 is used to direct air stored in reservoir 805 to first end 215 of pneumatic cylinder 105, the air pressure and volume applied to pneumatic cylinder 105 may move piston 115 in the first direction (e.g., the direction away from first end 215 of pneumatic cylinder 105). This linear motion of piston 115 (and correspondingly of piston rod 110) may be used to move the longitudinal doors of the railcar to an open position, as illustrated in FIG. 1B.

Alternatively, when valve 820 is used to direct air stored in reservoir 805 to second end 215 of pneumatic cylinder 105, the air pressure and volume applied to pneumatic cylinder 105 may move piston 115 in the second direction, opposite the first direction, and toward first end 215 of pneumatic cylinder 105. This linear motion of piston 115 (and correspondingly of piston rod 110) may be used to move the longitudinal doors of the railcar to an open position, as illustrated in FIG. 1A.

In certain embodiments, in addition to excessively pressurized air released through pressure relief valve 230 and directed into reservoir 805, trackside air may be used to fill reservoir 805. For example, as illustrated in FIG. 10, trackside air may be directed into reservoir 805 through hose/pipe/line 810.

The use of reservoir 805 may enable the gates or doors of a railcar to be operated at a first unloading facility using a capstan-driven air pump or compressor 210, where excess pressure generated by the capstan-driven air pump/compressor 210 is further used to pressurize reservoir 805. Then, at a second unloading facility, the gates or doors of the railcar may be operated using either a capstan-driven air pump/compressor 210 or reservoir 805, along with valve 820.

Figure 11:
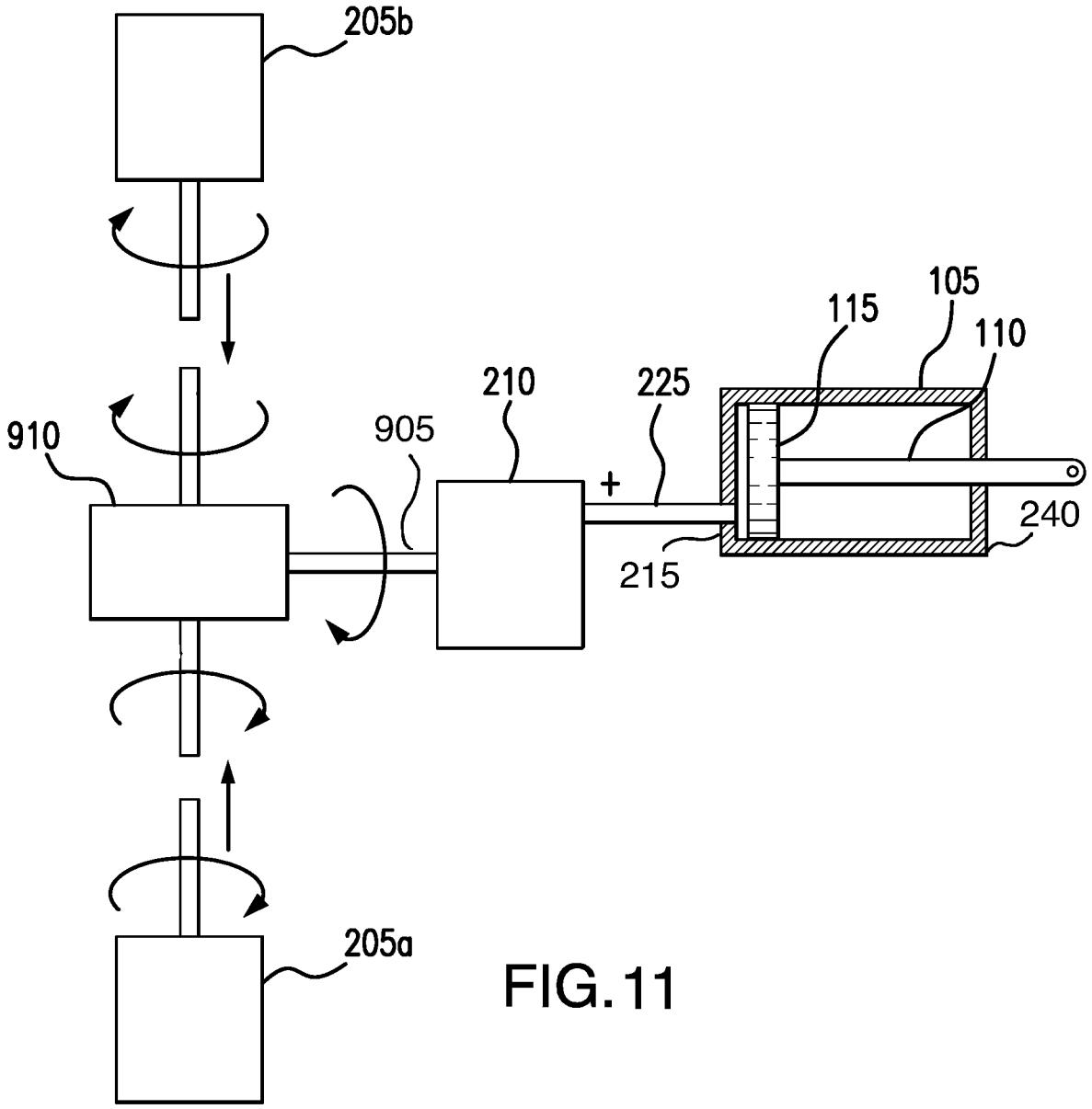
FIG. 11 illustrates an example embodiment of the capstan-driven air pump system in which the doors of the railcar may be opened using a capstan drive positioned on either side of the railcar.

FIG. 11 illustrates an example embodiment of the capstan-driven air pump system in which the doors of the railcar may be opened using a capstan drive positioned on either side of the railcar. As illustrated in FIG. 11, a first capstan drive 205*a* may be positioned on a first side of the railcar, and a second capstan drive 205*b* may be positioned on a second side of the railcar, opposite the first side.

Each capstan drive 205*a* and 205*b* is mechanically engaged to gear box 910. Gear box 910 is used to convert rotation generated by capstan drives 205*a* and 205*b* to rotation of component 915, used to drive air pump/compressor 210. This disclosure contemplates that gear box 910 may include any suitable components to convert rotation of the capstan drive in a first direction to rotation of component 915, connected to air pump/compressor 210, in a second direction.

In certain embodiments, gear box 910 may also allow the input rotational speed for first capstan drive 205*a* and/or second capstan drive 205*b* to be different than the rotational speed of component 915, connected to air pump/compressor 210. This disclosure contemplates that generating this rotational speed difference may be accomplished in any suitable manner. For example, in certain embodiments, internal gear ratios, pulleys, or a continuously variable system may be used. This may be desirable to permit torque or speed limiting devices to protect various system components, such as over-speed protection for air pump/compressor 210.

Figure 12:
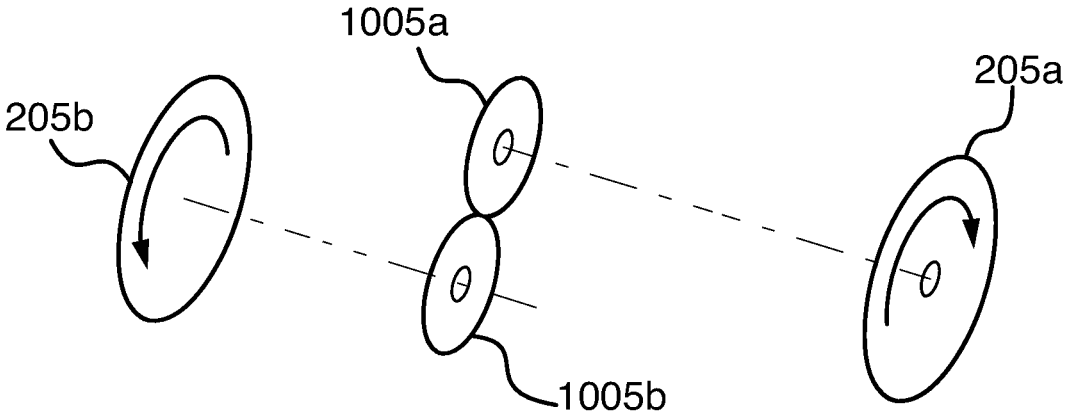
FIG. 12 illustrates an example manner in which capstan drives on either side of a railcar may be connected to one another.

FIG. 12 illustrates an example manner by which first capstan drive 205*a* and second capstan drive 205*b*, located on either side of a railcar, may be connected to one another inside gear box 910. As illustrated in FIG. 12, first capstan drive 205*a* and second capstan drive 205*b* may be connected to one another using first gear 1005*a* and second gear 1005*b*. This may permit clockwise rotation on each side of the railcar to create rotational motion of component 915 in the same direction, to drive air pump/compressor 210.

Figure 13:
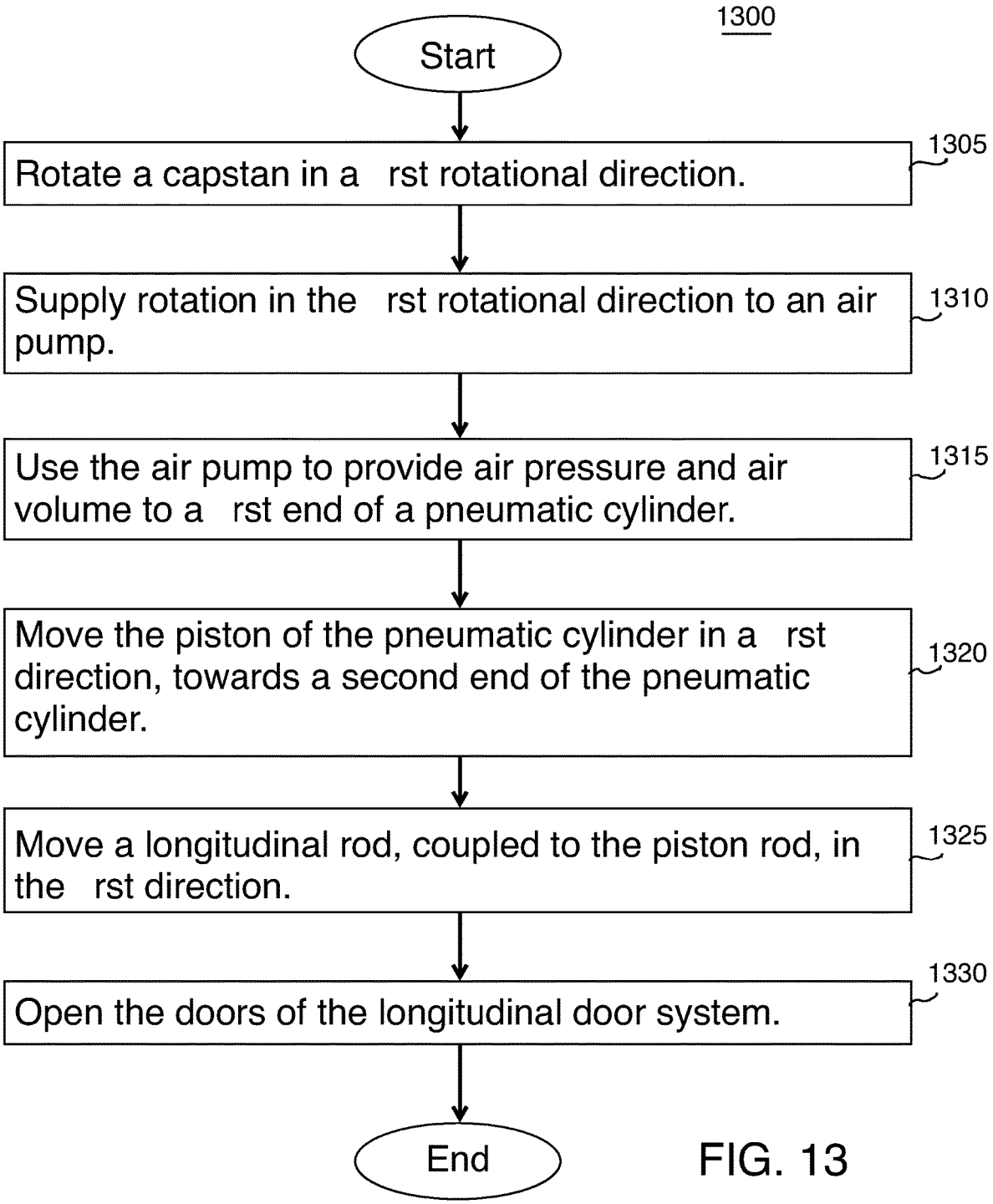
FIG. 13 presents a flowchart illustrating an example manner by which a capstan drive may be used to power an air pump to open the longitudinal doors of a railcar.

FIG. 13 presents a flowchart illustrating an example manner by which a capstan drive may be used to power an air pump to open the longitudinal doors of a railcar. In step 1305, capstan drive 205 is rotated in a first rotational direction. In step 1310, capstan drive 205 supplies rotation in the first rotational direction to air pump/compressor 210. In step 1315, air pump/compressor 210 supplies air pressure and air volume to first end 215 of pneumatic cylinder 105. In step 1320, piston 115 of pneumatic cylinder 105 moves in a first direction towards second end 240 of pneumatic cylinder 105. In step 1325, longitudinal beam 120, coupled to piston rod 110, moves in the first direction. Finally, in step 1330, doors 125*a* and 125*b* open.

Modifications, additions, or omissions may be made to method 1300 depicted in FIG. 13. Method 1300 may include more, fewer, or other steps. For example, steps may be performed in parallel or in any suitable order. This disclosure contemplates that the steps may be performed by an individual, a machine, or any suitable device.

Figure 14:
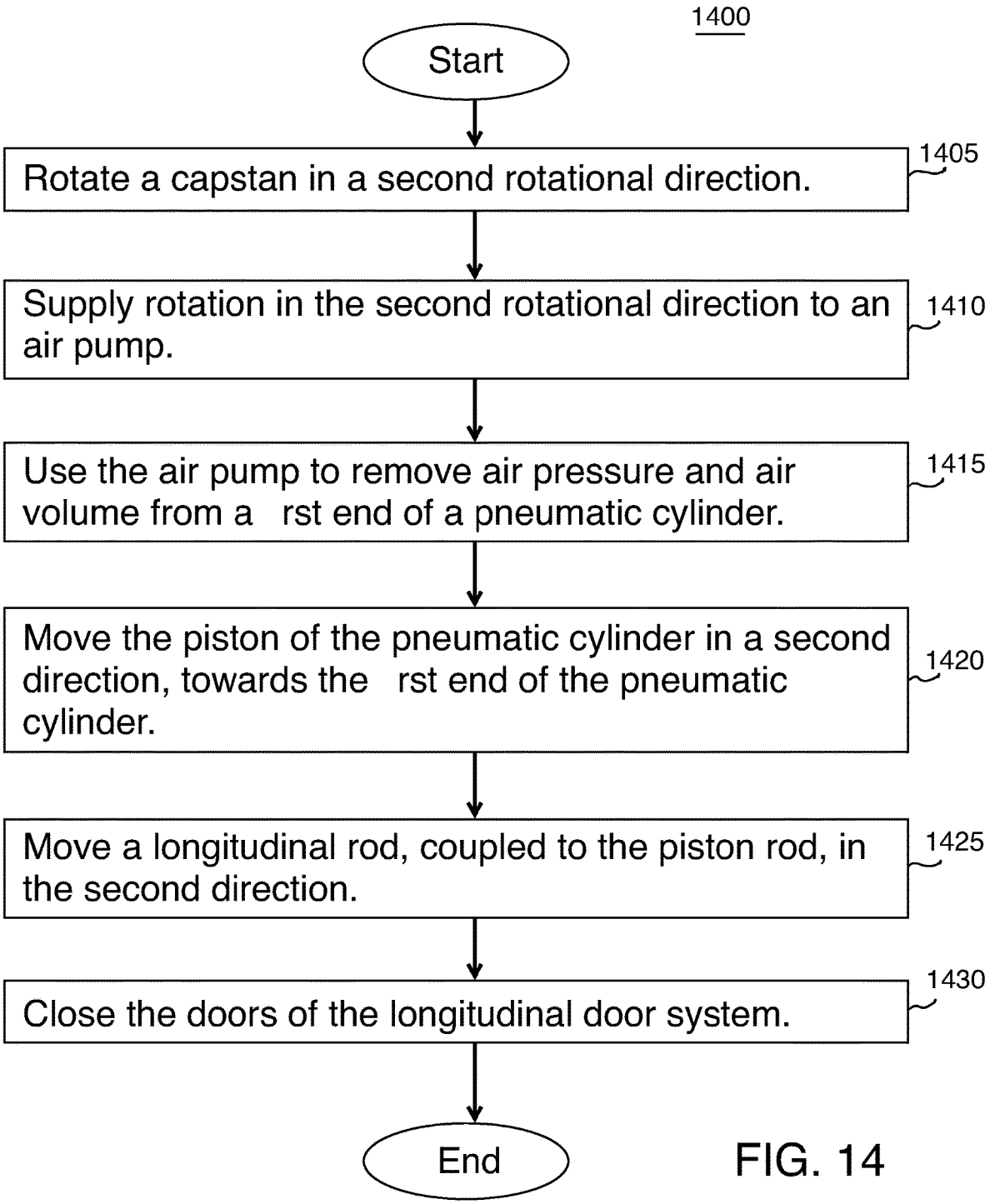
FIG. 14 presents a flowchart illustrating an example manner by which a capstan drive may be used to power an air pump to close the longitudinal doors of a railcar.

FIG. 14 presents a flowchart illustrating an example manner by which a capstan drive may be used to power an air pump to close the longitudinal doors of a railcar. In step 1405, capstan drive 205 is rotated in a second rotational direction, opposite the first rotational direction. In step 1410, capstan drive 205 supplies rotation in the second rotational direction to air pump/compressor 210. In step 1415, air pump/compressor 210 removes air pressure and air volume from first end 215 of pneumatic cylinder 105. In step 1420, piston 115 of pneumatic cylinder 105 moves in a second direction, opposite the first direction, towards first end 215 of pneumatic cylinder 105. In step 1425, longitudinal beam 120, coupled to piston rod 110, moves in the second direction. Finally, in step 1430, doors 125*a* and 125*b* close.

Modifications, additions, or omissions may be made to method 1400 depicted in FIG. 14. Method 1400 may include more, fewer, or other steps. For example, steps may be performed in parallel or in any suitable order. This disclosure contemplates that the steps may be performed by an individual, a machine, or any suitable device.

While discussed in terms of an embodiment for a hopper railcar, this disclosure contemplates that embodiments of the capstan-driven air pump system may be applied to other types of railcars, including, for example, gondola railcars. Furthermore, while discussed in terms of operating a pneumatic cylinder configured to push a beam to open longitudinal doors of a hopper railcar, this disclosure contemplates that the capstan-driven air pump system of the present disclosure may be used to open and close a variety of different doors and/or gates of railcars, including, for example, sliding gates.

As can be seen by one established in the art of railcar design, there are a number of ways that the capstan-driven air pump of the present disclosure may be incorporated into a railcar, both as a standalone system and in combination with other gate and door operating systems. For example, the capstan-driven air pump may be used in combination with hot shoe and/or manual operations.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as falling within the scope of this disclosure.

What is claimed is:

1. An apparatus comprising:

an air pump configured to couple to a capstan; and a pneumatic cylinder coupled to the air pump at a first end of the pneumatic cylinder, the pneumatic cylinder comprising a piston, wherein:

rotation of the capstan in a first rotational direction causes the air pump to provide air pressure to the first end of the pneumatic cylinder;

in response to the air pump providing air pressure to the first end of the pneumatic cylinder, the piston of the pneumatic cylinder moves in a first linear direction, wherein:

the piston is coupled to a longitudinal beam of a longitudinal door system of a railcar; and in response to the piston moving in the first linear direction, the longitudinal beam moves in the first linear direction, opening a door of the longitudinal door system.

2. The apparatus of claim 1, wherein:

rotation of the capstan in a second rotational direction opposite the first rotational direction causes the air pump to remove air from the first end of the pneumatic cylinder; and in response to the air pump removing air from the first end of the pneumatic cylinder, the piston of the pneumatic cylinder moves in a second linear direction opposite the first linear direction, wherein in response to the piston moving in the second linear direction, the longitudinal beam moves in the second linear direction, closing the door of the longitudinal door system.

3. The apparatus of claim 1, further comprising a pressure relief valve.

4. The apparatus of claim 1, further comprising a pressure gauge.

5. The apparatus of claim 1, wherein:

the pneumatic cylinder is further coupled to the air pump at a second end of the pneumatic cylinder, the second end opposite the first end; and rotation of the capstan in the first rotational direction causes the air pump to provide air pressure to the first end of the pneumatic cylinder and to remove air from the second end of the pneumatic cylinder.

6. The apparatus of claim 2, wherein:

the pneumatic cylinder is further coupled to the air pump at a second end of the pneumatic cylinder, the second end opposite the first end; and rotation of the capstan in the second rotational direction causes the air pump to remove air from the first end of the pneumatic cylinder and to provide air pressure to the second end of the pneumatic cylinder.

7. The apparatus of claim 1, further comprising:

a reservoir comprising pressurized air; and a valve coupled to the reservoir, the first end of the pneumatic cylinder, and the second end of the pneumatic cylinder, the valve comprising a first opening and a second opening, wherein:

in response to opening the first opening of the valve:

air flows from the reservoir to the first end of the pneumatic cylinder; and the piston of the pneumatic cylinder moves in the first linear direction; and in response to opening the second opening of the valve:

air flows from the reservoir to the second end of the pneumatic cylinder; and the piston of the pneumatic cylinder moves in the second linear direction.

8. The apparatus of claim 7, further comprising a pressure relief valve coupled to the reservoir, wherein in response to pressure within the pneumatic cylinder exceeding a threshold, the pressure relief valve is configured to open to provide pressurized air to the reservoir.

9. The apparatus of claim 7, wherein the reservoir further comprises an air inlet, wherein an external air source is configured to couple to the air inlet to supply pressurized air to the reservoir.

10. The apparatus of claim 7, wherein the reservoir further comprises a second pressure relief valve configured to open in response to pressure within the reservoir exceeding a threshold.

11. The apparatus of claim 1, further comprising a gear box coupled to the air pump, the gear box configured to couple to a first capstan located on a first side of the railcar and a second capstan located on a second side of the railcar, the gear box configured to:

convert a first rotation of the first capstan to a third rotation supplied to the air pump; and convert a second rotation of the second capstan to the third rotation supplied to the air pump, wherein in response to the gear box supplying the third rotation to the air pump, the air pump is configured to provide air pressure to the first end of the pneumatic cylinder.

12. The apparatus of claim 1, wherein a speed of the first rotation of the first capstan is different from a speed of the third rotation supplied to the air pump.

13. A method comprising:

rotating a capstan in a first rotational direction;

supplying, by the capstan, first rotation to an air pump;

in response to supplying the first rotation to the air pump, supplying, by the air pump, air pressure and air volume to a first end of a pneumatic cylinder, the pneumatic cylinder comprising a piston;

in response to supplying the air pressure and the air volume to the first end of the pneumatic cylinder, moving the piston of the pneumatic cylinder in a first linear direction;

in response to moving the piston in the first linear direction, moving a longitudinal beam of a longitudinal door system of a railcar in the first linear direction, the longitudinal beam coupled to the piston; and in response to moving the longitudinal beam in the first linear direction, opening a door of the longitudinal door system.

14. The method of claim 13, further comprising:

rotating the capstan in a second rotation direction opposite the first rotational direction;

supplying, by the capstan, second rotation to the air pump;

in response to supplying the second rotation to the air pump, removing, by the air pump, air pressure and air volume from the first end of the pneumatic cylinder;

in response to removing the air pressure and the air volume from the first end of the pneumatic cylinder, moving the piston of the pneumatic cylinder in a second linear direction opposite the first linear direction;

in response to moving the piston in the second linear direction, moving the longitudinal beam in the second linear direction; and in response to moving the longitudinal beam in the second linear direction, closing the door of the longitudinal door system.

15. The of claim 13, wherein, in response to supplying the first rotation to the air pump, the method further comprises removing, by the air pump, air pressure and air volume from a second end of the pneumatic cylinder, the second end opposite the first end.

16. The method of claim 14, wherein, in response to supplying the second rotation to the air pump, the method further comprises supplying, by the air pump, air pressure and air volume to a second end of the pneumatic cylinder, the second end opposite the first end.

17. The method of claim 13, further comprising:

opening a first opening of a valve, the valve coupled to a reservoir comprising pressurized air, the first end of the pneumatic cylinder, and the second end of the pneumatic cylinder;

in response to opening the first opening of the valve, supplying air from the reservoir to the first end of the pneumatic cylinder;

in response to supplying the air from the reservoir to the first end of the pneumatic cylinder, moving the piston of the pneumatic cylinder in the first linear direction;

opening a second opening of the valve;

in response to opening the second opening of the valve, supplying air from the reservoir to the second end of the pneumatic cylinder; and in response to supplying the air from the reservoir to the second end of the pneumatic cylinder, moving the piston of the pneumatic cylinder in the second linear direction.

18. The method of claim 17, further comprising providing, using a pressure relief valve coupled to the reservoir, pressurized air to the reservoir, wherein in response to pressure within the pneumatic cylinder exceeding a threshold, the pressure relief valve is configured to open.

19. The method of claim 17, further comprising providing, using an air inlet coupled to the reservoir, pressurized air to the reservoir, wherein an external air source is configured to couple to the air inlet.

20. The method of claim 13, further comprising:

converting, by a gear box, a rotation of a first capstan in a first direction to a rotation in a third direction;

converting, by the gear box, a rotation of a second capstan in a second direction to the rotation in the third direction;

supplying the rotation in the third direction to the air pump; and in response to supplying the rotation in the third direction to the air pump, providing air pressure to the first end of the pneumatic cylinder.

21. The method of claim 13, wherein a speed of the rotation of the first capstan in the first direction is different from a speed of the rotation in the third direction supplied to the air pump.

* * * * *